US007428804B2

(12) United States Patent
Surowiecki

(10) Patent No.: US 7,428,804 B2
(45) Date of Patent: Sep. 30, 2008

(54) SHEET METAL FRAMING WALL WITH BRACING BEAMS BETWEEN THE STUDS

(76) Inventor: Matt F. Surowiecki, 10023 Martin Luther King Jr. Way South, Seattle, WA (US) 98178

( * ) Notice: Subject to any disclaimer, the term of this patent is extended or adjusted under 35 U.S.C. 154(b) by 176 days.

(21) Appl. No.: 11/212,421

(22) Filed: Aug. 27, 2005

(65) Prior Publication Data

US 2007/0044417 A1 Mar. 1, 2007

(51) Int. Cl.
*E04C 3/30* (2006.01)
*E04C 2/38* (2006.01)

(52) U.S. Cl. ..... 52/696; 52/656.1

(58) Field of Classification Search ..... 52/696, 52/693, 690, 729.5, 729, 739.1, 729.1, 167.3, 52/146, 150, 149, 127.2, 641, 645, 656.1
See application file for complete search history.

(56) References Cited

U.S. PATENT DOCUMENTS 3,840,124 A * 10/1974 Atwater ..... 211/182
4,007,570 A * 2/1977 Hunter ..... 52/317
6,189,277 B1 * 2/2001 Boscamp ..... 52/317
6,260,318 B1 * 7/2001 Herren ..... 52/317
6,705,056 B2 * 3/2004 Tollenaar ..... 52/317
7,127,862 B2 * 10/2006 Saldana ..... 52/715

FOREIGN PATENT DOCUMENTS

DE GB2174428 A * 1/1985

* cited by examiner

*Primary Examiner*—Brian Glessner
*Assistant Examiner*—Adriana Figueroa
(74) *Attorney, Agent, or Firm*—Delbert J. Barnard

(57) ABSTRACT

One or more diagonal brace beam sections (26) extend between a pair of connectors (32). One of the connectors is placed inside of a first stud (14) that opens towards a closed side of the next stud (14) the second connector member (32) abuts against the web of the second stud (14). The connectors (32) are connected to the studs (14) by screw fasteners or some other suitable form of fasteners. The several diagonal brace beam sections (26) form an internal brace beam for the wall that extends from an upper corner at one end of the wall downwardly to a lower corner at the opposite end of the wall.

10 Claims, 8 Drawing Sheets

Fig. 2
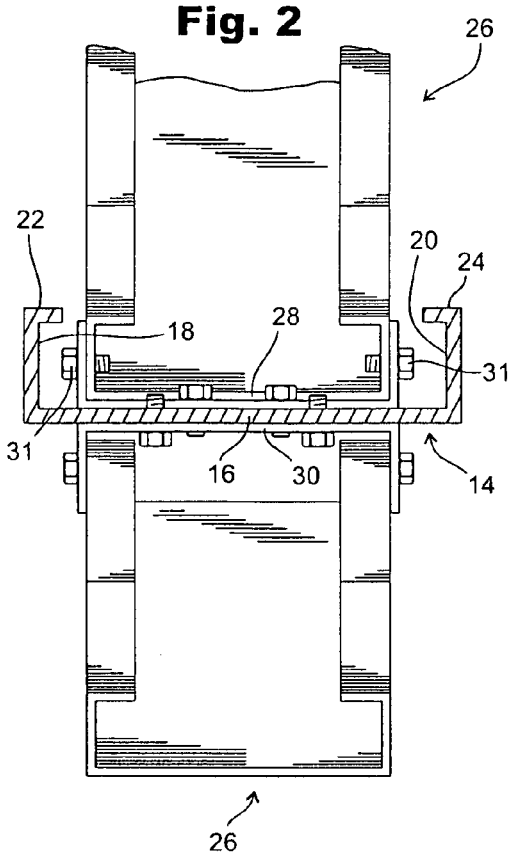
Fig. 3
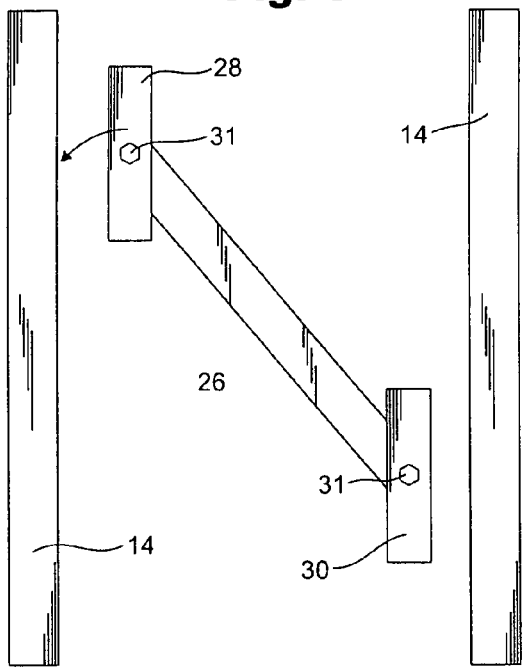
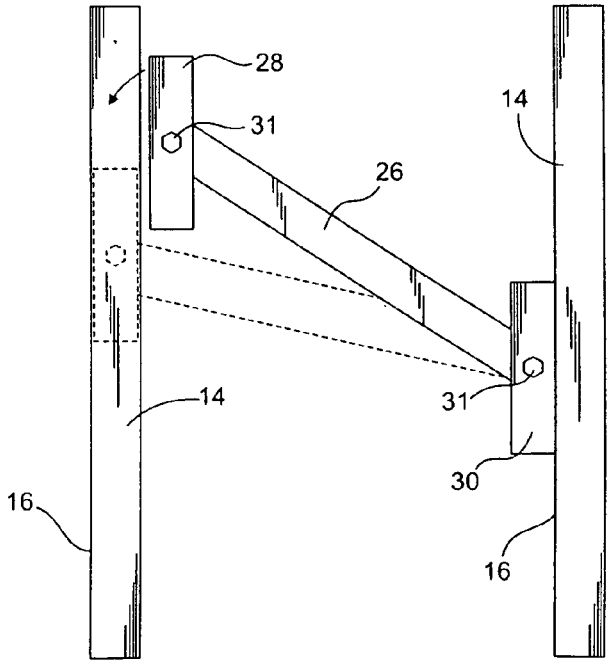
Fig. 4

SHEET METAL FRAMING WALL WITH BRACING BEAMS BETWEEN THE STUDS

TECHNICAL FIELD

This invention relates to framing walls comprising horizontal and vertical sheet metal framing members. More particularly, it relates to framing walls in which bracing beam sections are provided between the studs for bracing the wall along a diagonal line or lines.

BACKGROUND OF THE INVENTION

U.S. Pat. No. 5,784,850, granted Jul. 28, 1998, to William L. Elderson, and U.S. Pat. No. 6,021,618, granted Feb. 8, 2000, to William L. Elderson, show prior art framing that includes a bracing member extending horizontally through openings in the webs of sheet metal studs. Some walls need to be braced better than other walls, e.g. walls that are subjected to high wind loads. A known way of bracing these walls is to attach diagonal sheet metal straps to the flanges of the studs on one or both sides of the wall. Wall board is installed over the straps. A problem with this practice is that the straps distort the wall board enough that it is no longer planar and this can be seen. An object of the present invention is to provide a bracing system for a framing wall comprising diagonal braces which are positioned between the studs so that exterior straps and the distortion to the wall board that they cause are eliminated.

There is a need for an improved way of bracing a framing wall without the use of openings in the webs of the studs or straps on the outsides of the studs. The principal object of the present invention is to meet this need.

BRIEF SUMMARY OF THE INVENTION

A wall structure of the present invention includes first and second sheet metal studs, each in the form of a channel having a closed side formed by a web and an open side formed by and between spaced apart flanges. The open side of the first stud faces the closed side of the second stud. A first connector member is positioned inside the first stud. It has a web that is connected to the web of the first stud and a pair of flanges that project from said web towards the second stud. A second member has a web that is connected to the web of the second stud and a pair of flanges projecting from said web towards the first stud. A brace beam extends between the studs and connector members. The brace beam has a first end that is inside the first connector member and a second end that is inside the second connector member. The flanges of the first connector member are connected to the first end of the brace beam and the flanges of the second connector member are connected to the second end of the brace beam.

In one embodiment, the web of the first connector member is connected to the web of the first stud by screw fasteners and the web of the second connector member is connected to the web of the second stud by screw fasteners. It is also within the scope of the invention to weld the brace beam to the first and second connector members. According to an aspect of the invention, the flanges of the first connector member are connected to the first end of the brace by a screw fasteners and the flanges of the second connector member are connected to the second end of the brace beam by screw fasteners.

Preferably, the brace beam extends at a diagonal to the first and second studs.

In preferred form, the first and second studs each includes inwardly directed lips on the flanges extending parallel to each other and to the web and perpendicular to the flanges.

According to an aspect of the invention, the ends of the brace beams are connected to the connector members by screw fasteners which extend through the side flanges of the connector members and screw into the side flanges of the brace beam, forming a pivotable connection between the connector members and the ends of the brace beam. This allows the brace beam to be positioned substantially vertically between a pair of studs. Then, the brace beam is rotated to allow placement of the first connector member inside of the first stud and the web of the second connector against the web of the second stud. The brace beam is of such a length that when the webs of the connectors are against the webs of the studs, the brace beam extends at a diagonal to the first and second studs. Then, screw fasteners are used to connect the studs to the two connector members, to in that manner connect the ends of the brace beam to the two studs.

In another embodiment of the invention, the ends of brace beams are welded to connector members, one of which is inserted into a first stud and the other of which is connected to the web on the outside of a second stud. The sheet metal material is resilient enough to allow positioning of the brace beam between two studs, with the connector at one end of the brace beam inside of the first stud, and placement of the connector at the second end against the outer surface of the web of the second stud.

Other objects, advantages and features of the invention will become apparent from the description of the illustrated embodiments, set forth below, from the drawings, from the claims and from the principles that are embodied in the specific structures that are illustrated and described.

BRIEF DESCRIPTION OF THE SEVERAL VIEWS OF THE DRAWINGS

Like reference numerals are used to designate like parts throughout the several views of the drawing, and:

FIG. 2 is a sectional view taken substantially along line 2-2 of FIG. 1;

FIG. 3 is a view showing a brace beam/connector member assembly positioned between a first stud and a second stud, with the connector members spaced from the studs;

FIG. 4 is a view like FIG. 3, but showing a first connector member inside of the first stud and the web of the second member against the web of the second stud, and the brace beam extending at a diagonal to the first and second studs;

DETAILED DESCRIPTION OF THE ILLUSTRATED EMBODIMENT

Figure 1:
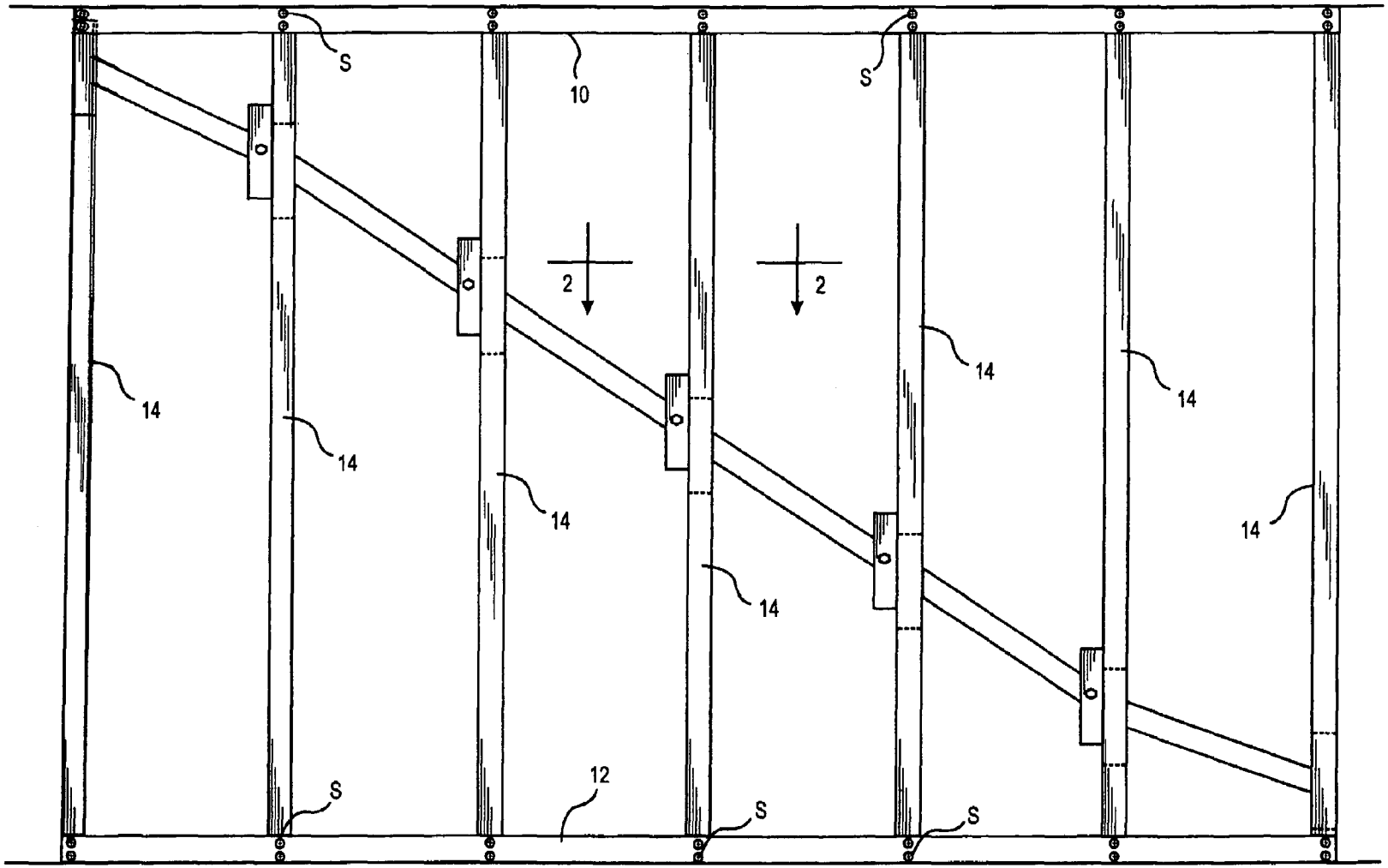
FIG. 1 is an elevational view of a framing wall formed of upper and lower tracks, vertical studs and diagonal brace beams between the studs.

FIG. 1 shows a framing wall comprising an upper track or "header" 10, a lower track or "footer" 12, and a plurality of studs 14. The lower ends of the studs 14 fit down into the footer 12 and the upper ends of the studs 14 fit up into the header 10. Screws (some of which are designated) S are used to secure the header 10 and the footer 12 to the studs 14. The framing members 10, 12, 14 are made from sheet metal, preferably steel. The members 10, 12 are channels composed of a web and a pair of flanges that extend perpendicular from the web, giving the members 10, 12 a U-shaped cross section. As best shown by FIG. 2, the studs 14 may be in the nature of lipped channels. They are each composed of a web 16, a pair of flanges 18, 20 and a pair of lips 22, 24. The flanges 18, 20 are parallel to each other and perpendicular to the webs of the members 10, 12. The lips 22, 24 are parallel to the web 16 and are perpendicular to the flanges 22, 24. Screw fasteners S extend through the flanges of the header 10 and screw into the upper ends of the flanges of the studs 14. In similar fashion, screw fasteners S extend through the flanges of the footer 12 and screw into the lower ends of the flanges of the studs 14. What has been described so far is conventional structure.

Figure 5:
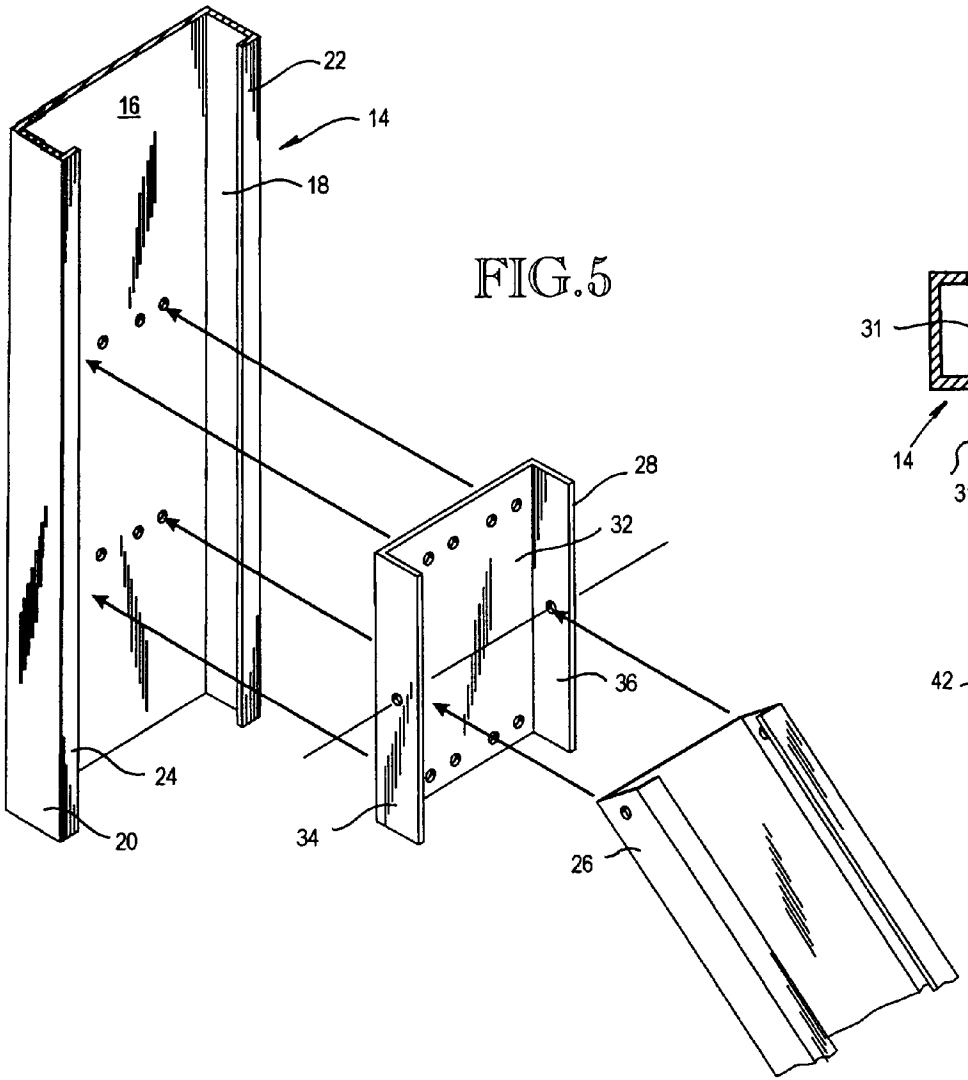
FIG. 5 is a fragmentary exploded view of a portion of a stud, a connector member and the end portion of a diagonal brace beam.

Referring to FIG. 3, a diagonal brace member 26 is provided to be positioned between adjacent studs 14. Each brace beam section 26 has a connector 28 at one of its ends and a connector 30 at its other end. The ends of the brace beam section 26 may be pivotally connected to the connector members 28, 30 by bolts 31. As shown by FIGS. 2 and 5, the connector 28 is sized to fit inside of the stud 12, between the lips 22, 24. Connector 28 preferably is a channel member having a web 32 and two flanges 34, 36 each extending perpendicular from the web 32. The brace beam section 26 may be a lipped channel member (FIGS. 5 and 2) or a plain channel member (FIGS. 6 and 7), or a tubular member (not shown). Channel members may have their webs directed downwardly (FIGS. 2 and 6) or may have them directed upwardly (FIG. 7). As shown by FIG. 2, the ends of the brace beam section 26 are connected to the connector members 28, 30 by screw fasteners 31 that extend through the flanges of the connectors 28, 30 and screw into the flanges of the brace member 28. A brace member assembly 26, 28, 30 is positioned between a pair of studs 14, in the manner shown by FIG. 3. Then, the connector 28 is moved into the adjacent stud 14 and its web 31 is placed against the web 16 of the stud 14. Then, screw fasteners are used to connect the webs 32,16 together, as shown in FIG. 2. After the connector 28 is in place within its stud 14, the connector 30 is positioned outwardly adjacent the web 16 of the second stud 14. Again, screw fasteners 31 are used to connect the connector web to the stud web, as shown in FIG. 2. As shown by FIG. 1, the plurality of brace beam assemblies 26, 28, 30 together form a diagonal line of brace beam sections 26 that extend from one upper corner of the wall down to the lower corner at the opposite end of the wall.

Figure 6:
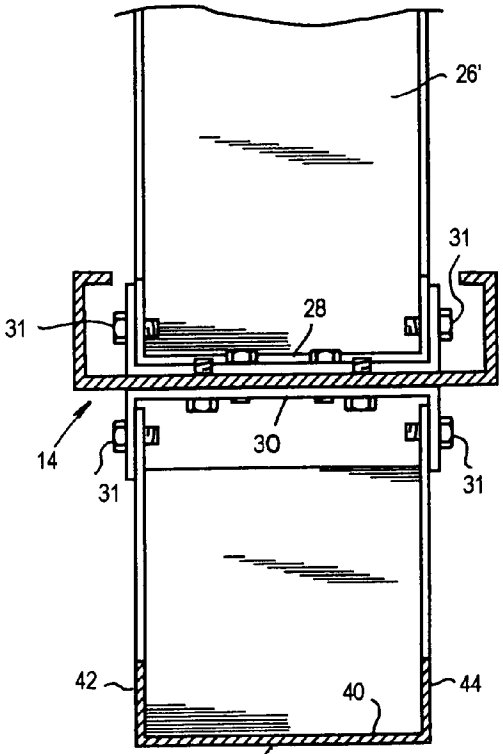
FIG. 6 is a view like FIG. 1, but showing channel shape diagonal brace beams that do not include lips.
Figure 7:
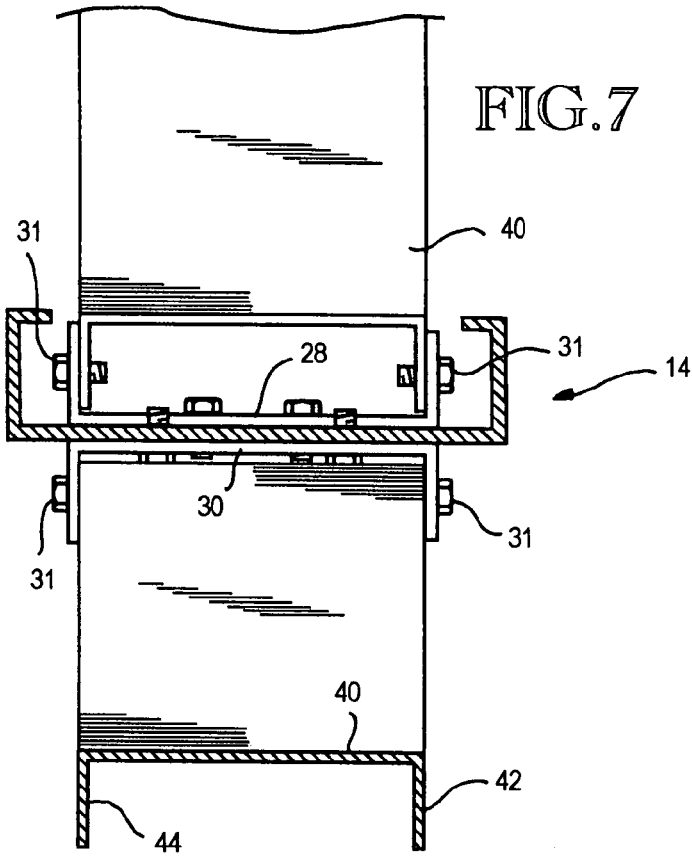
FIG. 7 is a view like FIGS. 2 and 6, showing the webs of the brace beams directed upwardly instead of downwardly.

As previously stated, the brace beam section 26' may be a plain channel member, composed of only a web 40 and a pair of flanges 42, 44, and the web 40 may be directed downwardly (FIG. 6). Or, the web 40 may be directed upwardly (FIG. 7).

Figure 8:
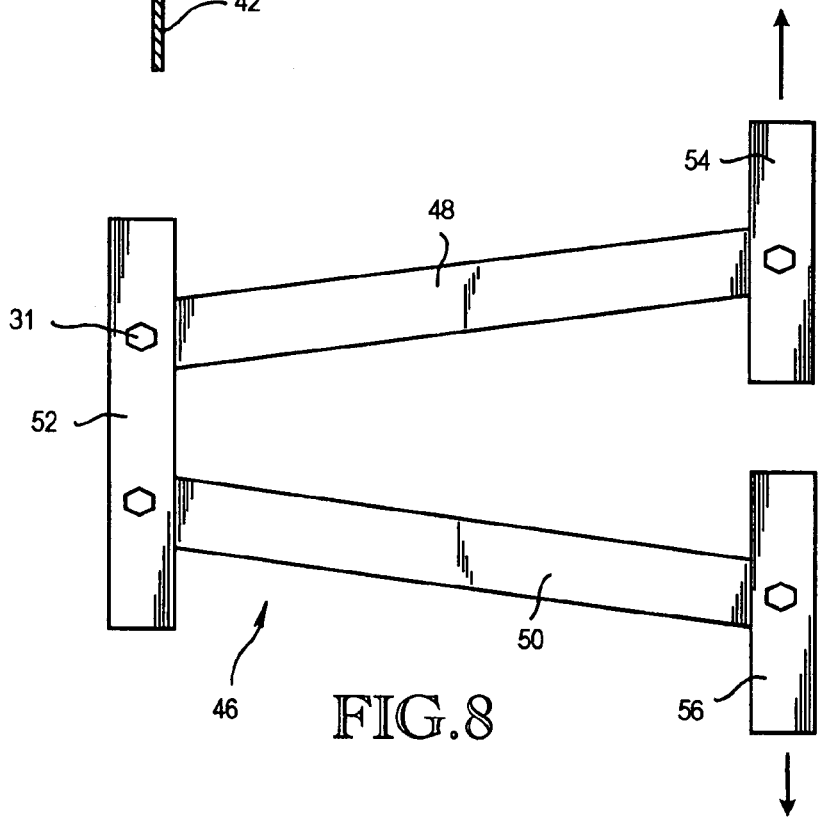
FIG. 8 is a view like FIGS. 3 and 4 minus the studs and showing one half of a center assembly.
Figure 17:
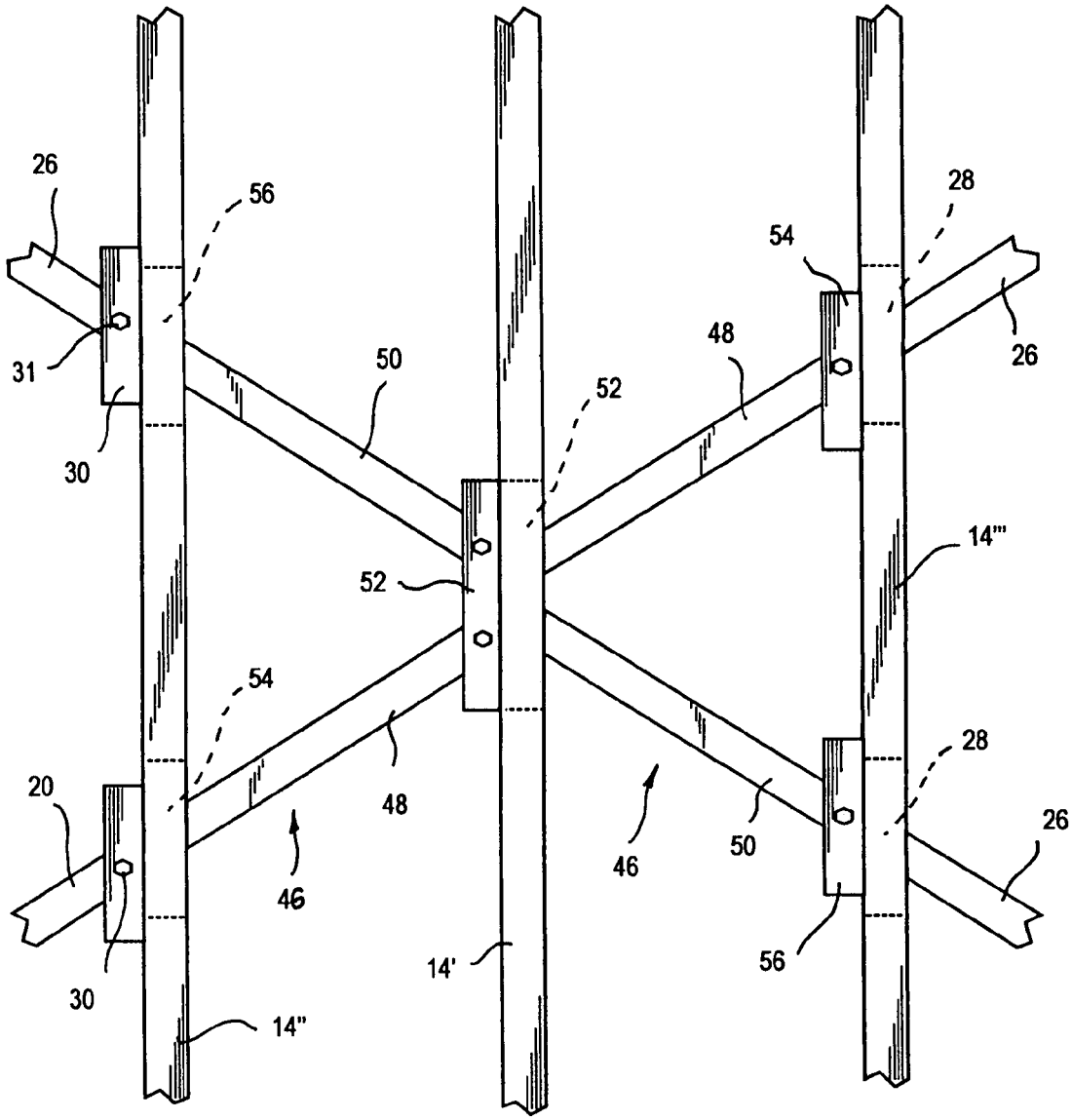
FIG. 17 is a fragmentary view of the center portion of FIG. 1, showing two of the assemblies shown by FIG. 8 position to create a center assembly or pair of crossing diagonal brace beam assemblies.

FIG. 8 shows one half of a center assembly 46. It comprises a pair of brace beam members 48, 50 and three connector members 52, 54, 56. The ends of brace beam section 48 is pivotally connected at its ends to connector 52 and connector 54. Brace beam section 50 is pivotally connected at its ends to connector 52 and connector 56. FIG. 17 shows a first assembly 46 positioned between the center stud 14' of a wall and the adjacent stud 14' on the left side of the center stud 14'. A second assembly 46 is turned upside down and positioned between center stud 14' and the adjacent stud 14" on the right side of the center stud 14'. The connectors 52, 54, 56 are connected to the studs 14', 14", 14''' in the same manner that the connectors 28, 31 are connected to the studs 14 in FIG. 4. As shown by FIG. 17, the brace beam sections 48 are on a diagonal line extending from a lower corner at one end of the wall to an upper corner at the opposite end of the wall. Brace beam sections 50 extend from an upper corner at the first end of the wall to a lower corner at the opposite end of the wall. Additional brace beam assemblies 26, 28, 30 are added to the ends of the brace beam sections 48 and 50 to complete the diagonal braces.

Figure 9:
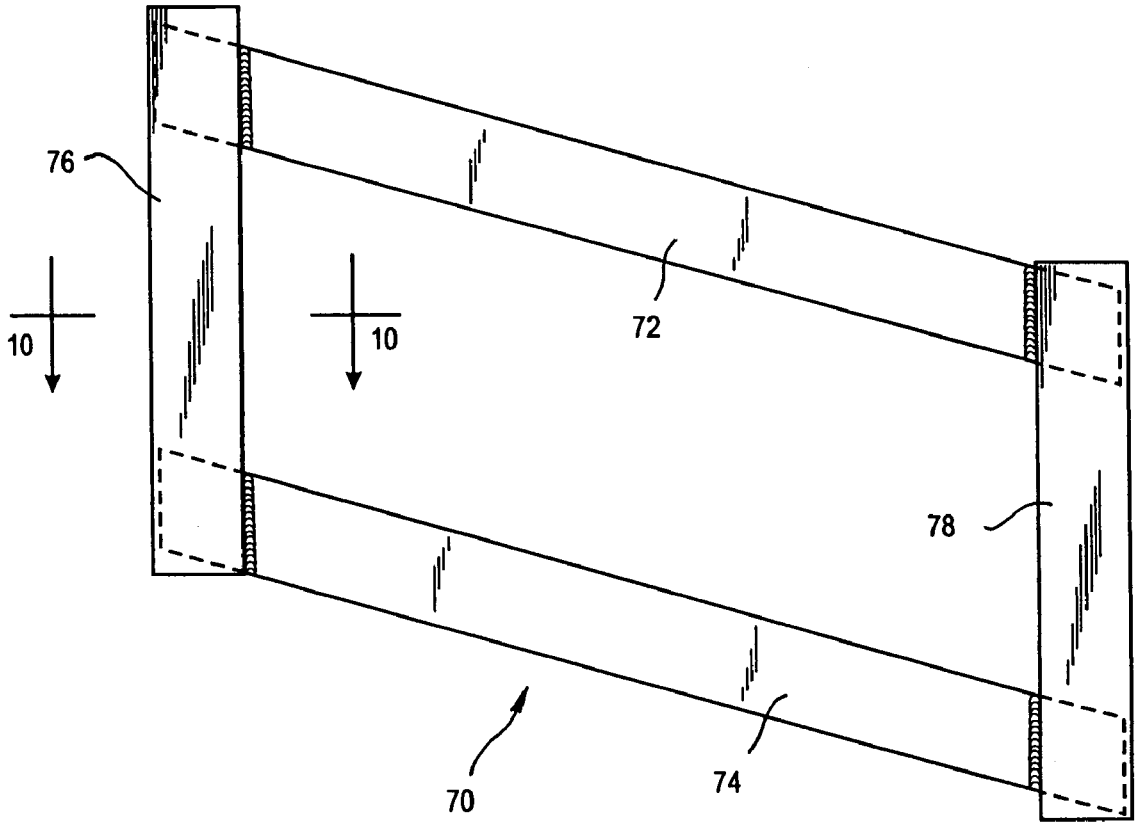
FIG. 9 is a modified insert comprising a pair of vertically spaced apart brace beams extending between a pair of horizontally spaced apart connector members.

FIGS. 9-16 relate to another embodiment of the invention. Referring first to FIG. 9, the brace beam assembly 70 comprises at least one diagonal brace beam section that is rigidly connected at its ends to connectors 76, 78. In FIGS. 9-16, the assembly 70 includes a pair of brace beam sections 72, 74. Each is welded or otherwise rigidly connected at its ends to the connectors 76, 78. As shown by FIGS. 10-13, the connectors 76, 78 are channel members having webs 80, 82 and flanges 84, 86, 88, 90. The brace beam sections 72, 74 are channel members or tubular members. The channel members may have the webs directed either upwardly or downwardly. The end portions of the beam sections 72, 74 fit within the connectors 82, 84, between the flanges 84, 86 and 88, 90, as shown in FIGS. 10-13.

Figure 10:
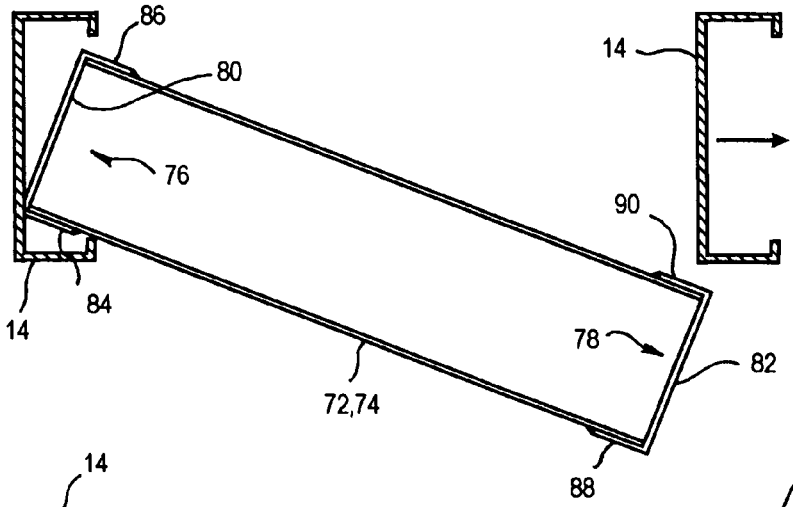
FIG. 10 is a sectional view taken substantially along line 10-10 of FIG. 9, showing the assembly of FIG. 9 being placed between two studs.
Figure 11:
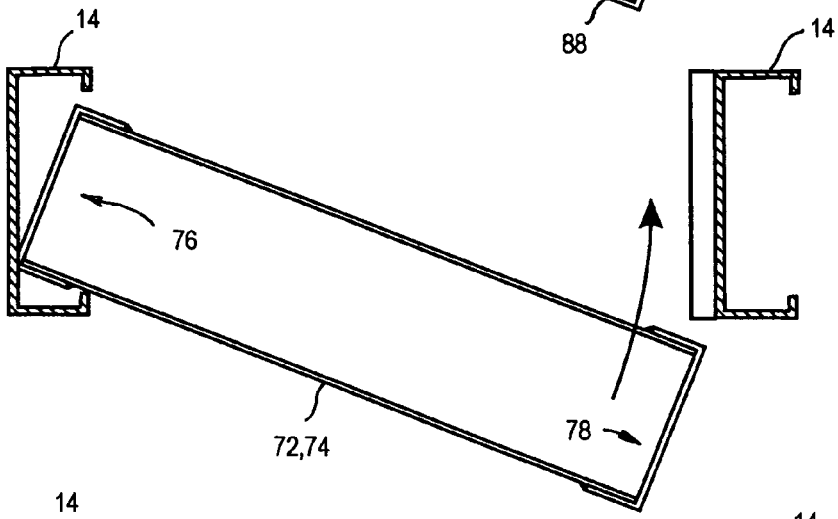
FIG. 11 is a view like FIG. 10, showing one of the studs being bolts so as to permit the second end portion of the brace beam assembly to be swung into place between the two studs.
Figure 12:
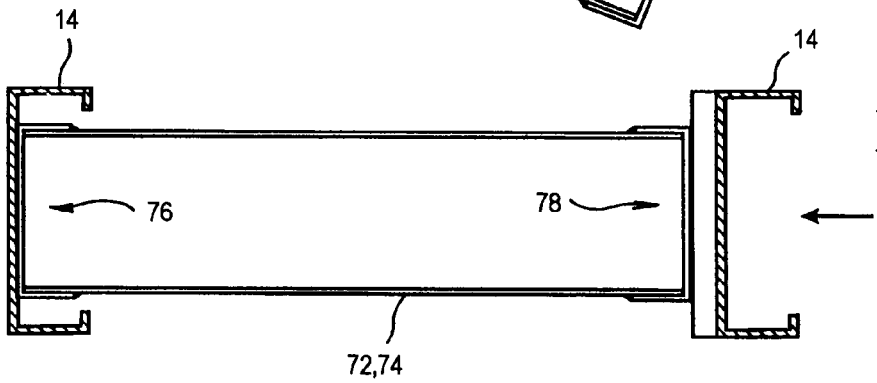
FIG. 12 is a view like FIG. 11, showing the brace beam assembly between the two studs.
Figure 13:
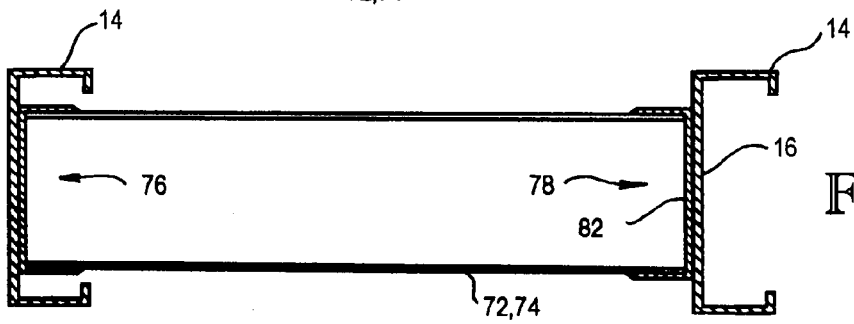
FIG. 13 is a view like FIG. 12, but showing the second stud relaxed to take the bow out of it.
Figure 16:
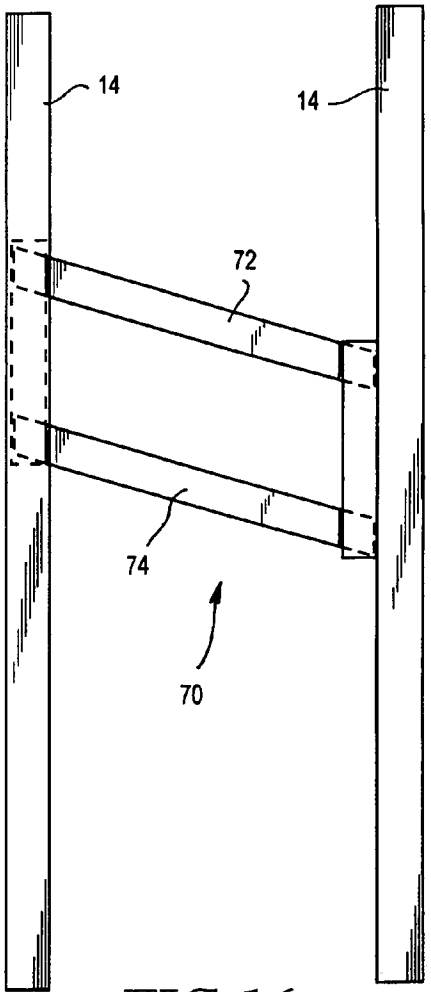
FIG. 16 is a side elevational view of FIG. 13.
Figure 15:
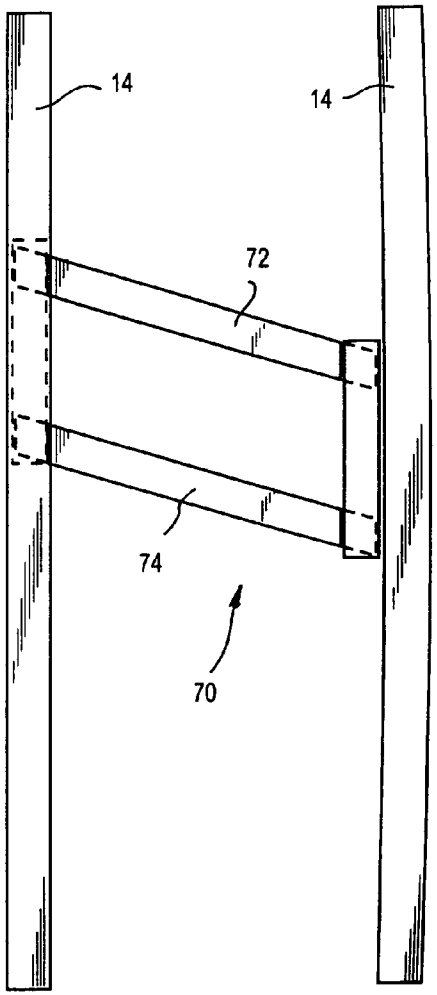
FIG. 15 is a side elevational view of FIG. 12.
Figure 14:
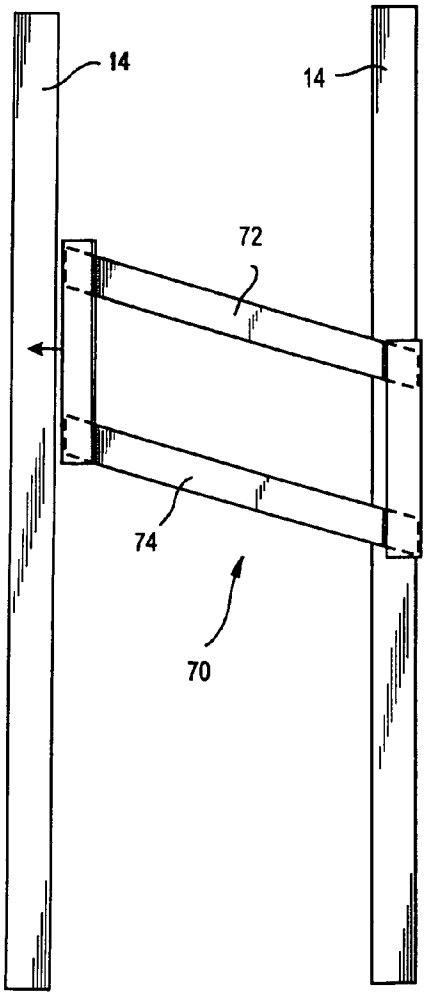
FIG. 14 is a side elevational view of FIG. 10.

The embodiment of FIGS. 10-16 is installed in the following manner. The end of the assembly that includes connector 76 is installed inside of a first stud 14 that opens towards the closed side of a second stud 14 (FIG. 10). Then, the end of the assembly 70 that includes connector 78 is rotated while the stud 14 is bowed outwardly (FIG. 11). It is rotated until it is in a position between the two studs 14. Then the force on the second stud 14 causing it to bow is released, allowing the second stuff 14 to move with its web 16 against the web 82 of the connector 78 (FIG. 13). Then, screw fasteners are used to connect the studs 14 to the connectors 76, 78. As can be seen from FIGS. 14-16, a plurality of the brace beam assemblies 70 may be installed in a stud wall starting from its left end and continuing over to its right end. This would provide upper and lower diagonal lines of brace beam sections extending from the upper left corner of the wall to the lower right corner of the wall. Herein, the term "flanges" is to be interpreted to include opposite sidewalls of a rectangular tubular member.

The illustrated embodiments are only examples of the present invention and, therefore, are non-limitive. It is to be understood that many changes to the particular structure, materials and features of the invention may be made without departing from the spirit and scope of the invention. Therefore, it is my intention that my patent rights not be limited by the particular embodiments that are illustrated and described herein, but rather are to be determined by the following claims, interpreted according to accepted doctrines of patent claim construction, including use of the doctrine of equivalents.

What is claimed is:

1. A wall structure, comprising:

first and second sheet metal studs, each in the form of a channel having a closed side formed by a web and an open side formed by and between spaced apart flanges;

said open side of the first stud facing the closed side of the second stud;

wherein the first and second studs each includes inwardly directed lips on the flanges extending parallel to each other and to the web and perpendicular to the flanges;

a first connector member having a web and a pair of flanges that project from said web perpendicular to the web and parallel to each other;

a second connector member having a web and a pair of flanges that project from said web perpendicular to the web and parallel to each other;

a brace beam having a first end positioned between the flanges of the first connector member and a second end positioned between the flanges of the second connector member;

a first pivot connection between the flanges of the first connector member and the first end of the brace beam and a second pivot connection between the flanges of the second connector and the second end of the brace beam; and said first and second connectors and said brace beam being adapted to permit a pivotal movement of the brace beam relative to the first and second connector members so as to permit placement of the first and second connector members and the brace beam between the two studs, and then movement of the first connector member into the first stud, between the flanges of the first stud movement of the web of the first connector member into contact with the web of the first stud, and movement of the web of the second connector member against the web of the second stud, and then connection of the first connector member to the first stud and connection of the second connector member to the second stud, with the brace beam extending between the two studs.

2. The wall structure of claim 1, wherein the web of the first connector member is connected to the web of the first stud by screw fasteners and the web of the second connector member is connected to the web of the second stud by screw fasteners.

3. The wall structure of claim 2, wherein the flanges of the first connector member are connected to the first end of the brace beam by screw fasteners and the flanges of the second connector member are connected to the second end of the brace beam by screw fasteners.

4. The wall structure of claim 1, wherein the brace beam extends at a diagonal to the first and second studs.

5. The wall structure of claim 2, wherein the brace beam extends at a diagonal to the first and second studs.

6. The wall structure of claim 3, wherein the brace beam extends at a diagonal to the first and second studs.

7. The wall structure of claim 1, wherein the brace beam is a channel member including a web having opposite edges and a pair of parallel side flanges that extend from the edges perpendicular to the web of the brace beam.

8. The wall structure of claim 7, wherein the flanges of the first connector member are connected to the first end of the brace beam by screw fasteners that extend through the flanges of the first connector member and the flanges of the brace beam, and the flanges of the second connector member are connected to the second end of the brace beam by screw fasteners that extend through the flanges of the second connector member and the flanges of the second end of the brace beam.

9. The wall structure of claim 7, wherein the brace beam extends at a diagonal to the first and second studs.

10. The wall structure of claim 8, wherein the brace beam extends at a diagonal to the first and second studs.

* * * * *